US005598806A

United States Patent [19]

Stivers

[11] Patent Number: 5,598,806

[45] Date of Patent: Feb. 4, 1997

[54] THROUGH-HULL CABLE PLUG

[76] Inventor: Bradley A. Stivers, 128 N. 31St., Cornelius, Oreg. 97113

[21] Appl. No.: 588,869

[22] Filed: Jan. 19, 1996

[51] Int. Cl.[6] ..... B63B 59/02

[52] U.S. Cl. ..... 114/343; 114/221 R

[58] Field of Search ..... 114/343, 221 R, 114/227, 201 R, 199, 197, 198, 183 R, 173, 174, 177; 440/111, 112; 373/141, 173; 248/59, 284

[56] References Cited

U.S. PATENT DOCUMENTS

| | | | |
|---|---|---|---|
| 3,113,287 | 12/1963 | Renner | 340/8 |
| 3,753,219 | 8/1973 | King, Jr. | 340/5 |
| 3,765,242 | 10/1973 | Bailleu | 73/359 |
| 4,189,703 | 2/1980 | Bennett | 367/134 |
| 5,230,372 | 7/1993 | Westphal | 114/343 |
| 5,284,223 | 2/1994 | Fisher | 440/112 |
| 5,460,111 | 10/1995 | Frahn | 114/197 |
| 5,526,765 | 6/1996 | Ahearn | 114/343 |

OTHER PUBLICATIONS

M&E Marine 83, At least as early as Dec. 1, 1995.
M&E Marine 107, At least as early as Dec. 1, 1995.

*Primary Examiner*—Stephen Avila
*Attorney, Agent, or Firm*—Robert D. Varitz

[57] ABSTRACT

A through-hull cable plug provides for a water-tight passage of cable through a bore formed in a boat hull. The cable plug of the invention includes an elongate stuffing tube having a pre-determined diameter and including a cable-receiving slot which extends along the length thereof, and opens through a side thereof. The plug includes a head having a size greater than that of the pre-determined diameter, which head is located at one end of the stuffing tube and which also has a cable-receiving slot formed therein. The cable-receiving slot of the head is contiguous with the cable-receiving slot of the stuffing tube. A fastener is provided and is received on the other end of the stuffing tube. The fastener is conformal with the stuffing tube and is movable along the length thereof to form a compression, water-tight fitting along the length of the stuffing tube between the head and the fastener.

16 Claims, 3 Drawing Sheets

THROUGH-HULL CABLE PLUG

FIELD OF THE INVENTION

The invention relates to watercraft, and specifically to a through-hull cable plug which may be used to pass a cable through the hull of a vessel.

BACKGROUND OF THE INVENTION

Marine vessels, and particularly small commercial or pleasure boats are often equipped with sensing devices which aid in the safety and navigation thereof. In many instances, the sensing devices utilize a transducer which is intended to be mounted on the exterior of the hull of the vessel. Such transducers may sense water temperature, speed of a vessel, depth of the water under the vessel, the presence of marine life in the water, etc. The transducers are connected to a readout device by means of a cable, which is able to carry electrical signals from the transducer to the readout. Some transducers and readouts may use a fibre-optic cable.

The most common technique for passing a cable through the hull of a small commercial or pleasure vessel is to simply drill a hole in the hull, pass the cable through the hull, provide some type of backing on either the inner or outer side of the hole, or both, and then fill the hole with a suitable marine-grade sealant. While this is certainly a simple technique, it does have many drawbacks, including the eventual failure of the seal as the sealant hardens over time, and then begins to decay.

One of the most common forms of transducers is that associated with a depth finder, and includes some type of a sonic send/receive unit, and frequently includes a speed-sensing device, which has a paddle wheel as part of the sensor. Common forms of this type of transducer is attached to a cable having a specific connector on the other end thereon, for meeting with a I/O device. For this type of a transducer and cable device, the hole that is formed in the vessel hull must be large enough to accommodate passage of either the transducer or the cable therethrough, as the devices are frequently intended to have a cable of a fixed length. The cable is not intended to have the connector or the transducer removed therefrom during installation. Such connectors generally have a diameter of between one-half and one inch, requiring a fairly large hole to be formed in the hull of the vessel. A hole of a size sufficient to allow passage of such a connector or transducer is not easily, permanently sealed with known through-hull plugs. Additionally, if it becomes necessary to remove the cable, the plug and sealant must be easily removed, without damage to the vessel or the cable. Known plugs require the sealant to be cut or drilled out of the hull, which may result in damage to the cable and enlargement of the bore. These are not desirable features.

SUMMARY OF THE INVENTION

The through-hull cable plug of the invention provides for a water-tight passage of cable through a bore formed in a boat hull. The cable plug of the invention includes an elongate stuffing tube having a pre-determined diameter and including a cable-receiving slot which extends along the length thereof, and opens through a side thereof. The plug includes a head having a size greater than that of the pre-determined diameter, which head is located at one end of the stuffing tube and which also has a cable-receiving slot formed therein. The cable-receiving slot of the head is contiguous with the cable-receiving slot of the stuffing tube.

A fastener is provided and is received on the other end of the stuffing tube. The fastener is conformal with the stuffing tube and is movable along the length thereof to form a compression, water-tight fitting along the length of the stuffing tube between the head and the fastener.

Accordingly, it is an object of the invention to provide a through-hull cable plug which is easily installed and removed.

A further object of the invention is to provide a through-hull cable plug which provides a water-tight seal through a hull of a vessel.

Another object of the invention is to provide a plug which may accommodate hulls of varying thicknesses.

Another object of the invention is to provide a plug which allows passage of one or more cables therethrough.

A further object of the invention is to provide a plug which is sized to allow passage of a cable connector through a bore formed in the vessel hull, and which is operable to seal the full diameter of the bore.

Yet another object of the invention is to provide a plug which provides for a ninety-degree bend in a cable along the outer end or inner surface of the hull.

These and other objects and advantages of the invention will become more fully apparent as the description which follows is read in connection with the drawings.

BEST MODE OF PRACTICING THE INVENTION

Figure 1:
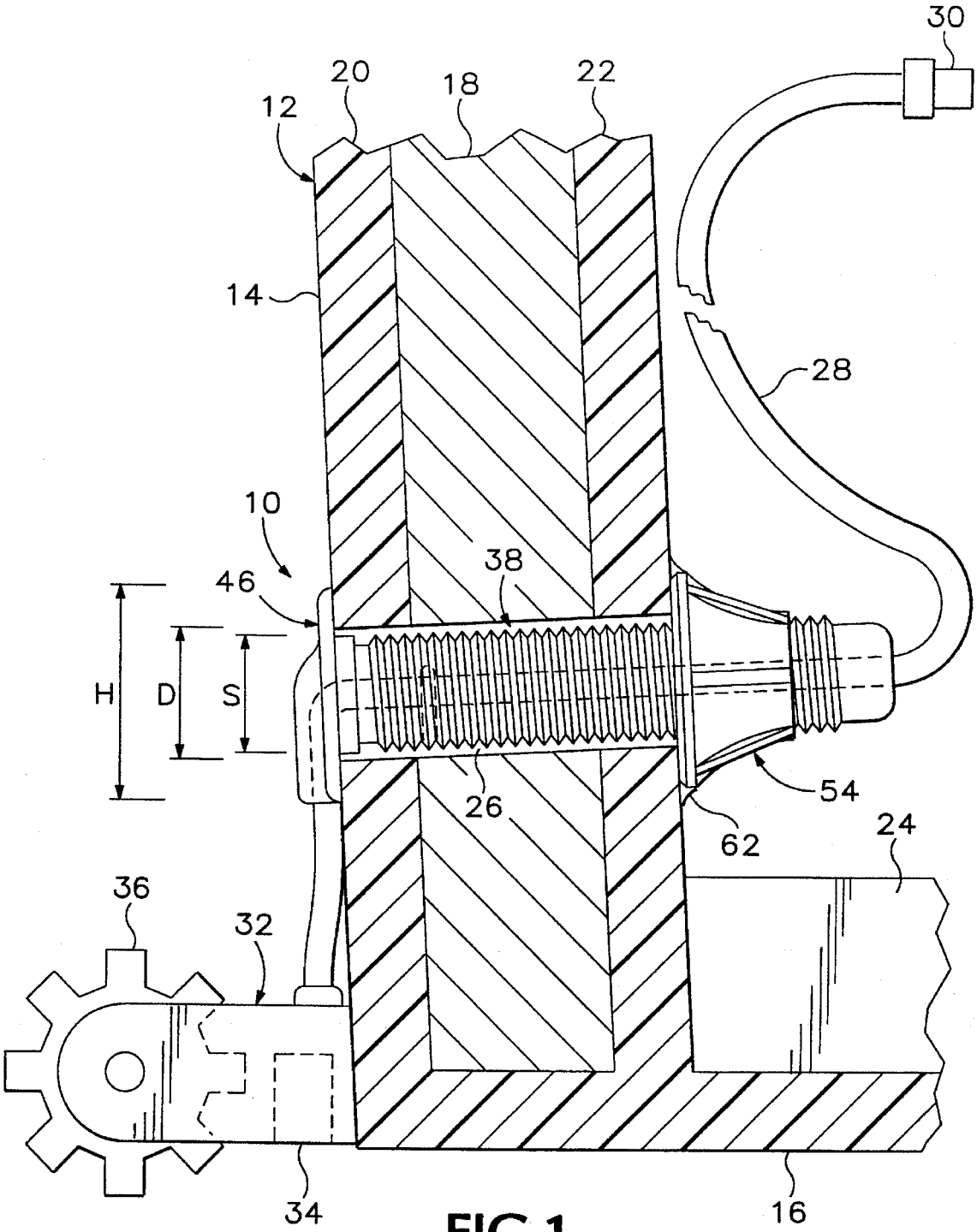
FIG. 1 is medial environmental elevation of the through-hull cable plug of the invention.
Figure 2:
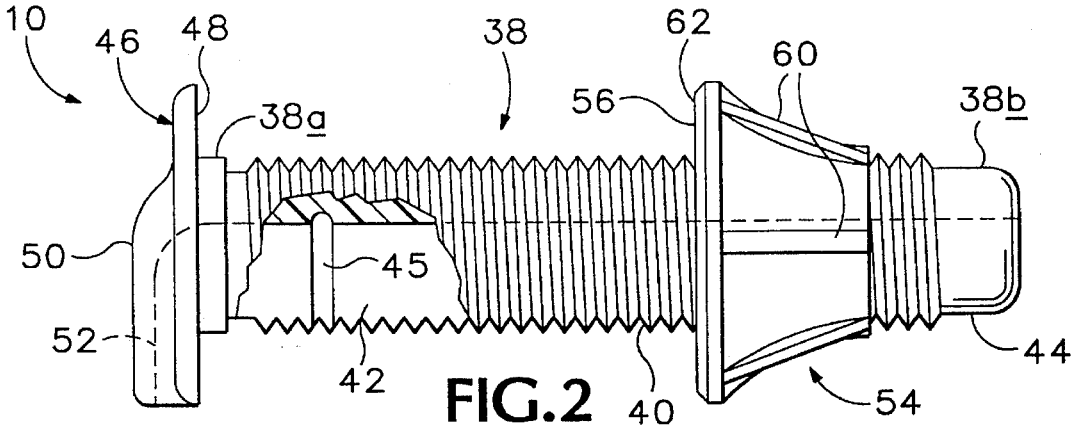
FIG. 2 is a side elevation of the cable plug of the invention, with portions broken away to show detail therein.
Figure 3:
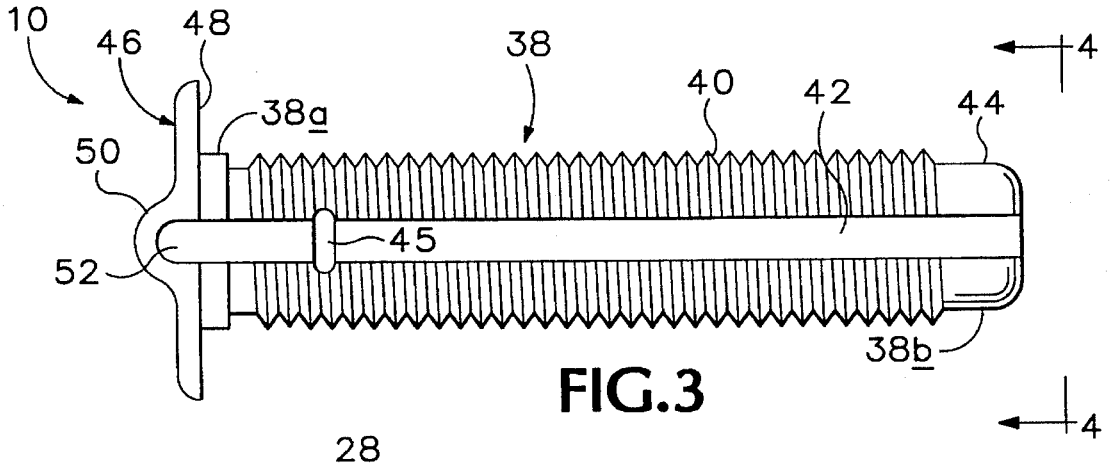
FIG. 3 is a bottom plan view of the cable plug of FIG. 2.
Figure 4:
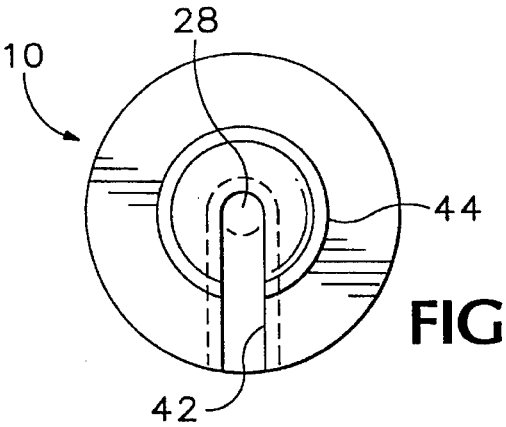
FIG. 4 is an end view of the cable plug, taken generally along the line 4—4 of FIG. 3.

Turning now to the drawings, and initially to FIG. 1, a through-hull cable plug constructed according to the invention is depicted generally at 10. Cable plug 10 is depicted installed in a boat hull 12 and specifically in the transom 14 thereof. Hull 12 includes a floor 16. As depicted, hull 12 is formed of fiberglass, with transom 14 having a wood core 18 therein, surrounded by fiberglass layers 20, 22. Fiberglass layers 20 and 22 are contiguous with hull floor 16 and cover a stringer which is depicted at 24. Plug 10 is located in a bore 26 which is formed through transom 14. Bore 26 is formed having a known diameter "D".

Plug 10 is intended to provide passage of a cable 28 through bore 26. Cable 28 may be a fixed length cable having a cable connector 30 formed on one end thereof, and fixed to a transducer 32 at the other end thereof. Transducer 32 is located on the exterior of hull 12. Bore 26 diameter "D" is sized to allow passage of connector 30 therethrough.

Transducer 32, as depicted in FIG. 1, includes multiple transducing units therein, including a depth transducer 34 and a speed transducer 36, which as depicted, takes the form of a paddle wheel.

In most instances, cable 28 is of a fixed length, and is provided, by the manufacturer, with transducer 32 attached atone end and cable connector 30 attached at the other end. Generally, it is not advisable to shorten or lengthen cable 28, as the electronic characteristics of the transducer may be governed by the length of cable 28. Whether or not the electronic characteristics are governed by the length of cable 28, removing and replacing cable connector 30 is generally not practical, as the cable connector is generally sealed to the cable, to prevent the incursion of moisture into the cable, to provide more reliable transmission there along.

Turning now to FIGS. 1–4, through-hull cable plug 10 will be described in greater detail. Cable plug 10 includes an elongate, cylindrically-formed portion, referred to herein as a stuffing tube 38. Stuffing tube 38 has a pre-defined diameter "S", which is sized to be clearance fittable through bore 26, and which is slightly larger that the diameter of cable connector 30. In the embodiment depicted in FIGS. 1–4, stuffing tube 38 has threads 40 extending along the length thereof. In alternative embodiments, stuffing tube 38 could have a smooth surface, or could have a suitable bayonet-type receptacle thereon.

A cable-receiving slot 42 extends along the length of stuffing tube 38 and extends through a side 44 thereof. Slot 42 is sized to receive cable 28 therein. Slot 42, as depicted is formed in a straight line down stuffing tube 38, however, slot 42 may also be formed in a spiral along stuffing tube side 44 so that the slot may a half, 180° rotation about the periphery of stuffing tube 38 so that the cable coming in at the bottom of stuffing tube 38 on the exterior of hull 12 exits the stuffing tube at the top thereof in the interior of hull 12. Slot 42 includes an enlarged portion 45 thereof, which is provided as a reservoir for sealant which will be used to enhance the water-tight characteristics of plug 10. Enlarged portion 45 allows a pool of sealant to completely surround cable 28 as the cable passes through slot 42.

A head 46 is located at one end **38*a* of stuffing tube 38, and has a diameter "H", which is larger than the predetermined diameter "S" of stuffing tube 38. Head 46 includes a disc portion 48 and a cable cover 50. Head 46 includes a radially-extending cable-receiving slot 52, which is contiguous with cable-receiving slot 42 in stuffing tube 38. Cable-receiving slot 52 provides for a 90° bend in cable 28, and also serves to hold the cable against the exterior of hull 12. It should be appreciated that cable plug 10 may also be installed in wood or metal hull vessels. In the case of a metal hull boat, such as an aluminum boat, the length of the stuffing tube may be considerably reduced, and, in some instances, the stuffing tube may be provided with threads which extend all the way to head 46**.

A fastener 54 is provided, and is received on the other end, **38*b* of stuffing tube 38, and is movable along the length thereof, to provide a water-tight seal between head 46, stuffing tube 38 and an abutment portion 56 of fastener 54. In the embodiment depicted, fastener 54 includes a central bore 58 which includes threads therein, which threads are conformal to threads 40 in stuffing tube 38. Fastener 54 may be formed, however, in other embodiments as a press-on fitting, or may be provided with a bayonet-type mount. Fastener 54 includes flanges 60 thereon to provide a grip for tightening fastener 54 on other end 38*b* of stuffing tube 38. Fastener 54 is formed with a chamfer 62 about the periphery of abutment portion 56 to provide an area between fastener 54 and hull 12 for a bead of sealant. It should be appreciated that bore 58 is sized to allow cable connector 30** to pass there through.

Figure 5:
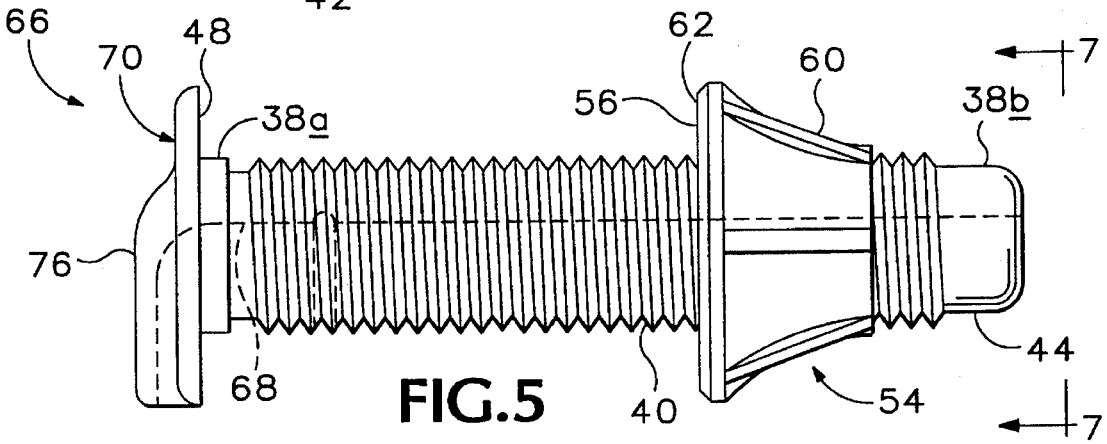
FIG. 5 is a side elevation of a modified cable plug constructed according to the invention.
Figure 6:
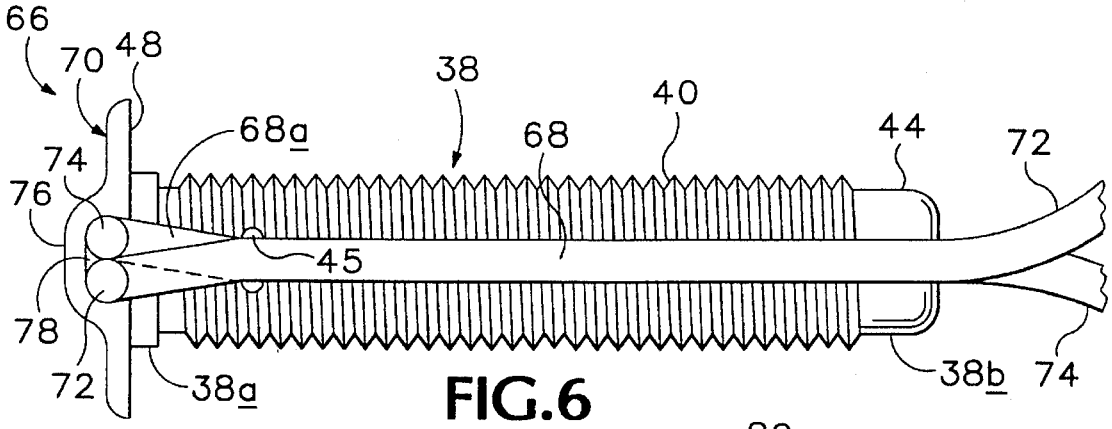
FIG. 6 is a bottom plan view of the cable plug of FIG. 5.
Figure 8:
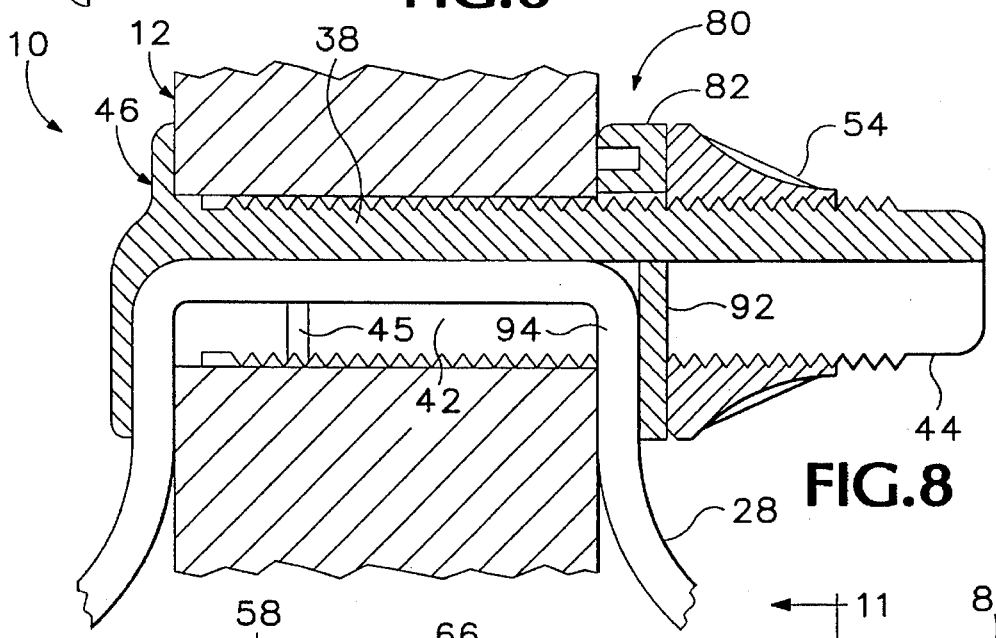
FIG. 8 is a medial environmental elevation of a modified form of the invention.
Figure 7:
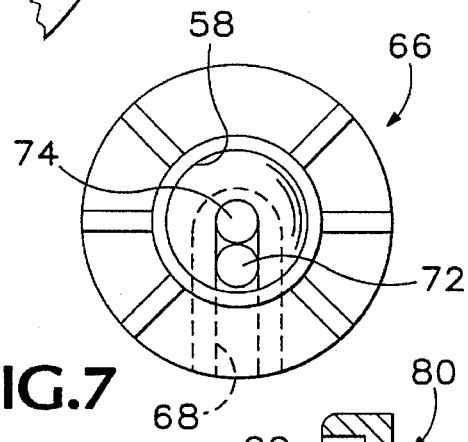
FIG. 7 is an end view of the cable plug, taken generally along the line 7—7 of FIG. 5
Figure 9:
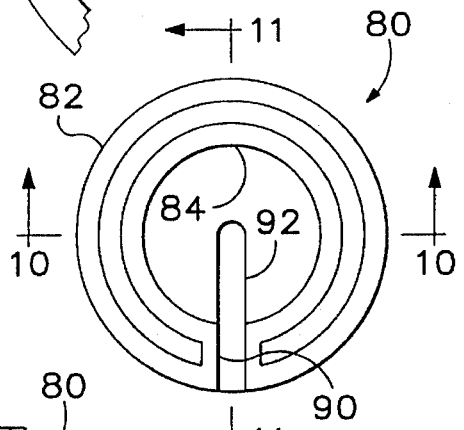
FIG. 9 is a front plan view of a washer element of the invention.
Figure 10:
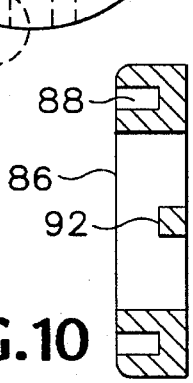
FIG. 10 is a bottom medial section of the washer element, taken generally along the line 10—10 of FIG. 9.
Figure 11:
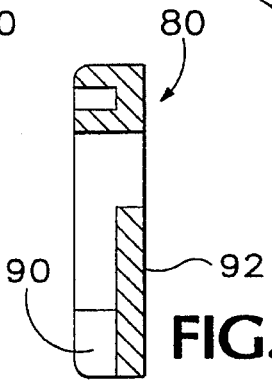
FIG. 11 is a side medial section of the washer element, taken generally along the line 11—11 of FIG. 9.

In the embodiment described thus far, plug 10 is intended to allow the passage of a single cable there through. Referring now to FIGS. 5–7, a second embodiment of a through-hull cable plug is depicted generally at 64. Like references numbers are used with plug 66 are used with plug 10 where the structures are the same. A difference between plugs 10 and 66 is the provision of a cable-receiving slot 68 in stuffing tube 38, which includes a flared portion **68*a* in slot 68 between enlarged portion 45 and a modified head 70, so that cables 72 and 74 may be arranged in a side-by-side condition as they pass into a widened cable cover 76, which includes a widened cable-receiving slot 78**.

Returning momentarily to FIG. 1, cable 28 may be seen to extend beyond the other end **38*b* of stuffing tube 38 into the interior of hull 12. In some instances, it may be desirable to have cable 28 make a ninety degree bend inside of hull 12. To this end, and now referring to FIGS. 8–11, a washer element 80 is provided. Although washer element 80 is depicted as being constructed and arranged to receive a single cable therein, it should be appreciated that the washer element may also be constructed similar to head 70 to accommodate more than one cable therein. Washer element 80 may be placed on stuffing tube 38 between the interior of hull 12 and fastener 54, to provide a snug, ninety degree bend in cable 28**.

Washer element 80 includes a disc portion 82 having a bore 84 extending there through. Bore 84 is sized to be clearance fittable over threads 40 on stuffing tube 38. Disc 82 includes a rim 86 thereabout, having a groove 88 formed therein. Disc 82 further includes a radially-extending slot 90 through the periphery thereof and has a finger-like projection 92 extending inwardly from the region of groove 88. Slot 90 is operable to form a 90° bend in cable 28 along the interior of hull 12. Projection 92 is received in cable-receiving slot 42 of stuffing tube 38, and is operable to provide a backing for cable 28 in the region on the ninety degree bend, indicated generally at 94.

Cable plug 10, and its associated parts may be manufactured by injection molding and/or milling process. The plug, fastener and washer elements are form from suitable plastic material.

To install the plug of the invention, regardless of whether a single or multi-cable plug is used, a bore 26 is formed in hull 12. Bore 26 is sized to provide a clearance fit for stuffing tube 38 and which will provided clearance for connector 30. A transducer is secured to the exterior of hull 12 and the cable 28 and cable connector 30 are passed through bore 26 into the interior of hull 12. Stuffing tube 38 is then inserted in bore 26 from the exterior of hull 12. At this time, a suitable marine sealant may be injected into cable-receiving slots 42 and 52 and into enlarged portion 45, so as to provide a water-tight seal along cable 28. The sealant will be provided with an expansion area in enlarged portion 45 to provide a complete encircling of cable 28 by sealant. Plug 10 is pressed firmly into place so that the interior of disc 48 contacts transom 14. Any remaining open spaces in cable-receiving slot 42 may be filled with sealant from the interior of hull 14 at this time. If desired, washer element 80 may be placed on the other end of stuffing tube 38 at this time, or, fastener 54 may be installed by passing it over cable connector 30 and cable 28, so as to allow reception of fastener 54 on the other end of stuffing tube 38. Fastener 54 is tightened enough to provide a secure fit of the cable plug in the boat hull.

To remove cable plug 10, fastener 54 is removed, as is washer element 80, if installed. Cable 28 is provided with slack on the interior of hull 12, and the cable is moved through slot 42 to a position away from the other end **38*b* of cable plug 10. The cable plug may then be pushed, or rapped lightly with a hammer or other object, to loosen it from bore 26. Once the cable plug is free of bore 26, cable 28 and connector 30 may be passed through bore 26 to the exterior of the hull. The cable may be pulled free from the sealant in slots 42 and 52**, thereby separating the cable from the cable plug.

Although a preferred embodiment of the invention, and a variation thereto have been disclosed herein, it should be appreciated that further variations and modifications may be made thereto without departing from the scope of the invention as defined in the appended claims.

I claim:

1. A through-hull cable plug for allowing water-tight passage of a cable through a bore formed in a hull, comprising:

an elongate stuffing tube of a predetermined diameter having a cable-receiving slot therein extending along the length thereof and opening to a side thereof and sized to extend through the hull;

a head of a size greater than said predetermined diameter located at one end of said stuffing tube, having a cable-receiving slot formed therein; and a fastener received on the other end of said stuffing tube, which is conformal therewith and movable along the length thereof to form a compression, water-tight fitting between said head and said fastener.

2. The through-hull cable plug of claim 1 which further includes a washer element, receivable on said stuffing tube between the hull and said fastener, said washer element having a radially-extending slot therein to form a 90° bend in the cable on the interior of the hull.

3. The through-hull cable plug of claim 1 wherein said cable-receiving slot in said head is radially-extending from the longitudinal axis thereof for forming a 90° bend in the cable.

4. The through-hull cable plug of claim 1 wherein said stuffing tube includes a threaded portion along the length thereof, and said fastener includes a bore therethrough having threads conformal to those of said stuffing tube.

5. The through-hull cable plug of claim 1 wherein said slot in said stuffing tube includes a flared portion to allow the insertion of multiple cables therein.

6. The through-hull cable plug of claim 1 wherein said slot in said stuffing tube includes an enlarged portion to allow the insertion of a sealant material into said slot.

7. A through-hull cable plug for allowing water-tight passage of an elongate, fixed-length cable through a bore formed in a hull, wherein the cable has a transducer fixed at one end thereof and a cable connector fixed at the other end thereof, comprising:

an elongate stuffing tube of a predetermined diameter having a cable-receiving slot therein extending along the length thereof and opening to a side thereof and sized to extend through the hull;

a head of a size greater than said predetermined diameter, integrally formed with said stuffing tube, located at one end thereof, having a radially-extending, cable-receiving slot formed therein for forming a 90° bend in the cable on the exterior of the hull; and a fastener received on the other end of said stuffing tube, which is conformal therewith and movable along the length thereof to form a compression, water-tight fitting between said head and said fastener.

8. The through-hull cable plug of claim 7 which further includes a washer element, receivable on said stuffing tube between the hull and said fastener, said washer element having a radially-extending slot therein to form a 90° bend in the cable on the interior of the hull.

9. The through-hull cable plug of claim 7 wherein said stuffing tube includes a threaded portion along the length thereof, and said fastener includes a bore therethrough having threads conformal to those of said stuffing tube.

10. The through-hull cable plug of claim 7 wherein said slot in said stuffing tube includes a flared portion to allow the insertion of multiple cables therein.

11. The through-hull cable plug of claim 7 wherein said slot in said stuffing tube includes an enlarged portion to allow the insertion of a sealant material into said slot.

12. The through-hull cable plug of claim 7 wherein said stuffing tube predetermined diameter is sized to be larger than the diameter of the cable connector.

13. A through-hull cable plug for allowing water-fight passage of an elongate, fixed-length cable through a bore formed in a hull, wherein the cable has a transducer fixed at one end thereof and a cable connector fixed at the other end thereof, comprising:

an elongate stuffing tube of a predetermined diameter having a cable-receiving slot therein extending along the length thereof and opening to a side thereof and sized to extend through the hull, said stuffing tube including a threaded portion along the length thereof, wherein said slot in said stuffing tube includes an enlarged portion to allow the insertion of a sealant material into said slot;

a head of a size greater than said predetermined diameter, integrally formed with said stuffing tube, located at one end thereof, having a radially-extending, cable-receiving slot formed therein for forming a 90° bend in the cable on the exterior of the hull; and a fastener received on the other end of said stuffing tube, which is conformal therewith and movable along the length thereof to form a compression, water-tight fitting between said head and said fastener, said fastener including a bore therethrough having threads conformal to those of said stuffing tube.

14. The through-hull cable plug of claim 13 which further includes a washer element, receivable on said stuffing tube between the hull and said fastener, said washer element having a radially-extending slot therein to form a 90° bend in the cable on the interior of the hull.

15. The through-hull cable plug of claim 13 wherein said slot in said stuffing tube includes a flared portion to allow the insertion of multiple cables therein.

16. The through-hull cable plug of claim 13 wherein said stuffing tube predetermined diameter is sized to be larger than the diameter of the cable connector.

* * * * *